United States Patent [19]

Kirk

[11] Patent Number: 4,914,775

[45] Date of Patent: Apr. 10, 1990

[54] RETAINER MECHANISM FOR DRAIN CLEANER DRUM

[75] Inventor: Karl L. Kirk, Elyria, Ohio

[73] Assignee: Emerson Electric Co., St. Louis, Mo.

[21] Appl. No.: 286,044

[22] Filed: Dec. 19, 1988

[51] Int. Cl.[4] ..... B08B 9/02

[52] U.S. Cl. ..... 15/104.33; 242/54 R; 254/134.3 FT

[58] Field of Search ..... 15/104.33, 104.31; 254/134.3 FT; 242/54 R

[56] References Cited

U.S. PATENT DOCUMENTS

| | | | |
|---|---|---|---|
| 2,730,740 | 1/1956 | O'Brien | 15/104.33 |
| 3,162,878 | 12/1964 | Agostino | 15/104.33 |
| 3,246,354 | 4/1966 | Cooney et al. | 15/104.33 |
| 3,298,051 | 1/1967 | Ratliff | 15/104.33 |
| 3,534,423 | 10/1970 | Ratliff | 15/104.33 |
| 3,605,158 | 9/1971 | Russell | 15/104.33 |
| 3,747,153 | 7/1973 | O'Neill | 15/104.33 |
| 4,364,139 | 12/1982 | Babb et al. | 14/104.33 |
| 4,447,926 | 5/1984 | Rothenberger | 15/104.33 |

*Primary Examiner*—Edward L. Roberts

*Attorney, Agent, or Firm*—Body, Vickers & Daniels

[57] ABSTRACT

A drain cleaner machine having a drain cleaning cable storage drum rotatable on an axle which is fixedly mounted on the machine frame or chassis. The drum is provided with releasable retainer mechanism for positively locking the drum in place on the axle for rotation thereon while being quickly releasable to free the drum for easy removal from the axle.

18 Claims, 3 Drawing Sheets

RETAINER MECHANISM FOR DRAIN CLEANER DRUM

This invention relates in general to drain cleaner or sewer augering machines and, more particularly, to a mounting arrangement for the rotatable cable storage drums of such machines.

BACKGROUND OF THE INVENTION

Drain cleaner or sewer augering machines commonly in use at present are generally comprised of a rotatably mounted storage drum containing a drain cleaning cable or so-called plumber's snake which consists of a central core wire or cable core with a helically wound armor in the form of a coil spring on the core to produce a very flexible cable or snake. The cable is fed into the drain pipe or sewer from the storage drum which is rotatably supported on a frame or chassis and rotated, as by an electric motor belt drive, to impart the necessary rotation to the cable to effect the cleaning of the drain pipe or sewer.

Heretofore, one of the problems that has existed in these types of machines has been the difficulty of disassembly of the rotary cable storage drums from the machine chassis for repair and cleaning and the need for immediate interchangeability of the drums as for the replacement thereof with one containing a different diameter cable or for permitting the addition of other lengths of cable to a cable already inserted in a pipe to be cleaned where the job demands a greater length of cable. The rotatable cable storage drums of prior drain cleaning machines generally have been provided themselves with the axle on which they rotate which then adds materially to the weight of the cumbersome drum and to the difficulty of handling the same when disassembling it from the chassis of the machine. In addition, the disconnection of such axle carrying drums from the machine chassis is itself a tedious and time consuming operation.

SUMMARY OF THE INVENTION

The present invention contemplates a new and improved drain cleaner apparatus which overcomes all of the above referred to problems and others and provides a drain cleaner machine which is of simplified construction and which affords easy and quick assembly of the rotary cable storage drum onto the machine and disassembly therefrom.

Briefly stated, in accordance with one aspect of the invention, the axle of the machine on which the drum is rotatably mounted is fixedly secured on the chassis or support frame of the machine and the drum is detachably locked in place on the axle for rotation thereon by an easily and quickly actuatable retaining mechanism.

In accordance with another aspect of the invention, the drum is provided with a hub having a bearing portion in which the axle is journaled to rotatably support the drum in place on the chassis of the machine, and the retaining mechanism comprises a readily accessible retainer latch member which is radially reciprocable in and biased radially inwardly of the hub so as to normally engage in an annular groove in the axle to lock the hub and associated drum in place on the axle for rotary movement thereon. The retainer latch is provided at its outer end with a hand grip which is exposed adjacent the back end wall of the drum for manually pulling the biasing latch radially outwardly to disengage the latch from within the annular groove in the axle so as to free the drum for axial removal therefrom.

According to still another aspect of the invention, the retaining latch member is biased radially inwardly of the hub to engage with the annular groove in the axle by an extension spring connected in a tensioned condition between the retainer latch member and the hub of the drum. The spring may comprise a tension coil spring connected at its opposite ends to an axially extending offset crook portion of the retainer latch member and looped around the hub of the drum in a tensioned condition, or it may comprise a garter spring or elastic band such as an O-ring looped around the axially offset portion of the retainer latch member and around the hub of the drum in an elastically tensioned condition.

According to a further aspect of the invention, the inner end of the retainer latch member engaged with the annular groove in the axle is beveled for camming engagement with the end of the axle, when the drum is axially moved onto the axle, to thereby displace the latch member radially outward to permit the free movement of the drum onto the axle to its latched position thereon.

According to a still further aspect of the invention, the hub of the drum includes a generally radially outward projecting flange portion extending alongside and fixedly secured to the back end wall of the drum, which wall is provided with a radially outward extending grooved recess providing a guide channelway, extending between the flange portion of the hub and the back end wall of the drum, for and through which the retainer latch extends and is guided for true radially outward movement when actuated to release the drum from the axle.

The principal object of the invention is to provide a drain cleaner machine with a rotary cable storage drum which is releasably journaled for rotation on an axle fixedly mounted on the machine chassis.

Another object of the invention is to provide a drain cleaner machine with a rotary cable storage drum which is quickly and easily detachable from a chassis mounted axle on which it is journaled for rotation.

Still another object of the invention is to provide a drain cleaner machine with a rotary cable storage drum having an integral retainer mechanism for releasably locking the drum in journaled position on a chassis mounted axle for rotation thereon.

A further object of the invention is to provide a drain cleaner machine with a rotary cable storage drum which is journaled for rotation on a supporting axle and which is more easily interchangeable with other like drums.

Further objects and advantages of the invention will be apparent from the following detailed description of a preferred embodiment thereof and from the accompanying drawings.

DESCRIPTION OF THE PREFERRED EMBODIMENT

Figure 1:
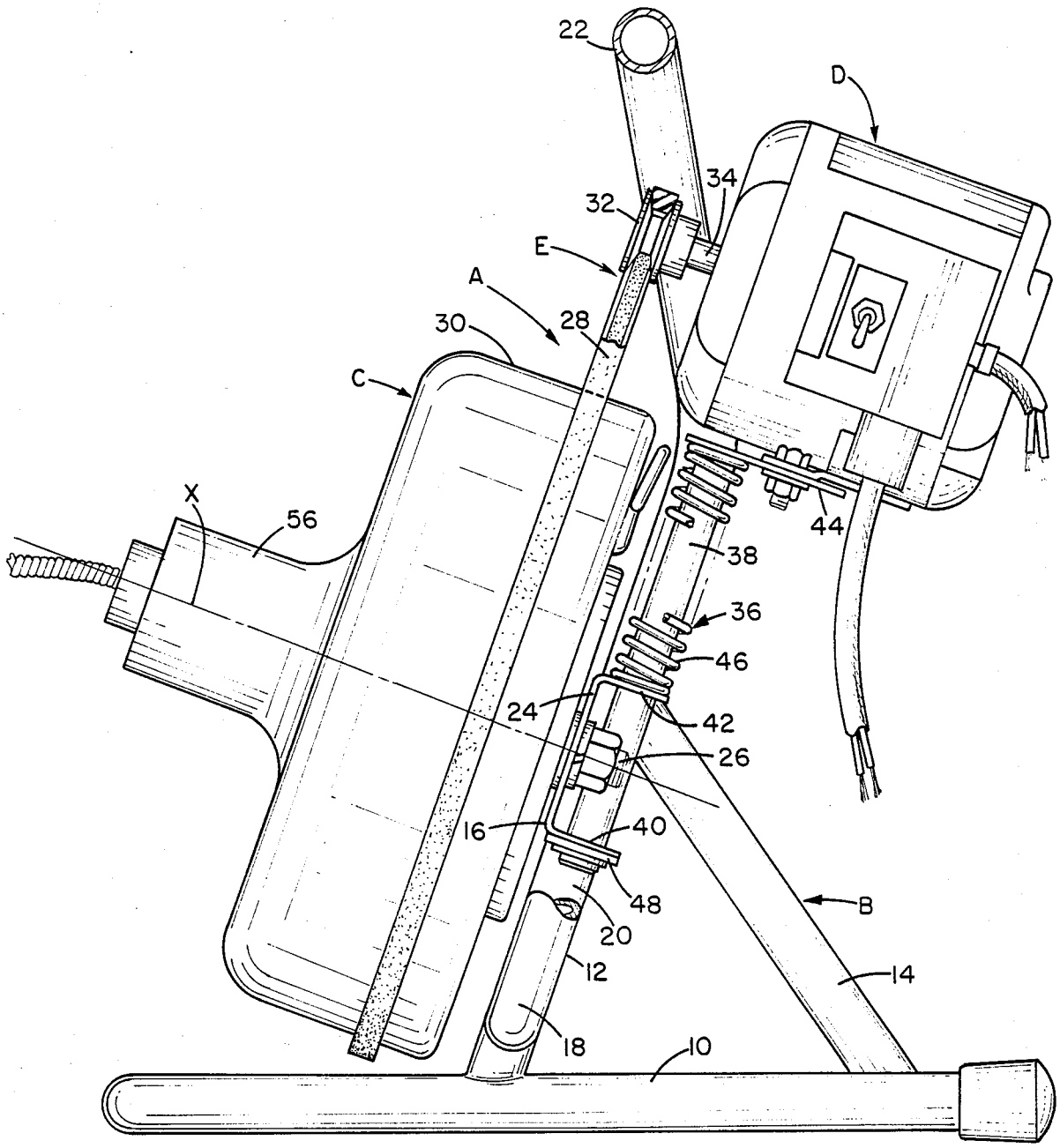
FIG. 1 is a side elevation, partly in section, of a drain cleaner machine according to the invention.
Figure 2:
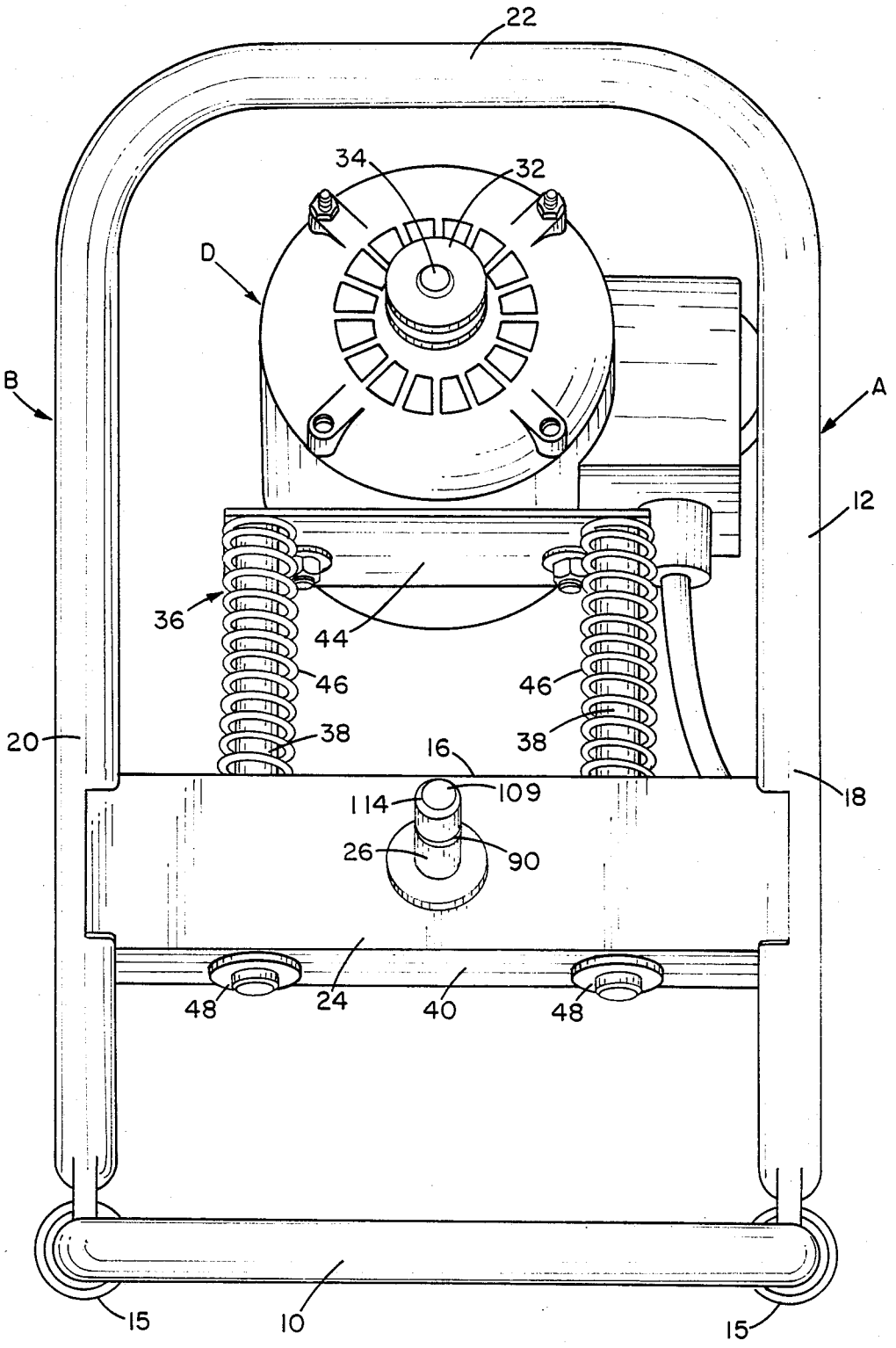
FIG. 2 is a front elevation of the machine shown with its rotary cable storage drum removed; and, FIG. 3 is a side elevation, partly in section and on an enlarged scale, of the rotary cable storage drum of the drain cleaner machine shown in FIG. 1.

Referring now to the drawings wherein the showings are for the purpose of illustrating a preferred embodiment of the invention only and not for the purpose of limiting same, the figures show a drain cleaner machine A comprised, in general, of a support frame or chassis B, a rotary cable storage drum C mounted for rotation on the chassis, and an electric motor D mounted on the chassis and adapted to rotate the drum C by a belt drive E. The support frame or chassis B is comprised of a U-shaped base member 10 made of tubular steel, an upright inclined U-shaped handle member 12 also made of tubular steel and welded to the base member 10, and a pair of angle brace members 14 of strap steel each welded to respective legs of the U-shaped base member 10 and the handle member 12 at an inclination opposite to that of the handle member for added support thereof. Rubber tips 15 are mounted on the free ends of the legs of the base member 10.

A horizontal channel steel crossbar member 16 extends between and is welded to the two inclined side arms 18, 20 of the U-shaped handle member 12 at a point thereon intermediate their base ends and their horizontal handle end 22. As shown, the channel crossbar member 16 is positioned on the handle 12 with its web wall 24 extending approximately parallel to the plane of the two side arms 18, 20 of the handle member 12. Secured to the web wall 24 of the crossbar member 10, as by being bolted thereon, to project normal thereto is an axle 26 on which the drum is rotatably mounted. The belt drive E for rotating the drum C comprises a drive belt 28 which is looped around the cylindrical outer surface 30 of the drum and around a drive pulley 32 on the outer end of the shaft 34 of the motor D in a tensioned condition.

The motor D is supported in a position above the drum C on a spring support 36 which acts to bias the motor upwardly so as to tension the drive belt 28 around the drive pulley 32 and around the drum C with the necessary force to effect the rotation of the drum around its support axle 26. The spring support 36 for the motor D comprises a spaced pair of upstanding support posts 38 extending parallel to the side arms 18, 20 of the handle 12 and slidably mounted in the two side flanges 40, 42 of the channel iron crossbar member 16 of the support frame B. The motor D is supported on the upper ends of the support posts 38 by a support plate 44 to which the motor is bolted and which is welded to the upper ends of the support posts. The two slidable support posts 38 and the motor D mounted thereon are biased upwardly, to tension the drive belt 28 around the drum 30 and motor drive pulley 32, by a pair of compression coil springs 46 each of which is telescoped over a respective one of the motor support posts 38 and compressed between the motor support plate 44 and the upper side flange 42 of the channel crossbar 16 of the machine frame B. Retaining collars 48 are provided on the lower ends of the motor support posts 38 to engage with the lower side flange 40 of the crossbar 16 to limit the upward bias movement of the support posts in the crossbar and prevent them from becoming disengaged therefrom when the belt is released from the drum.

Figure 3:
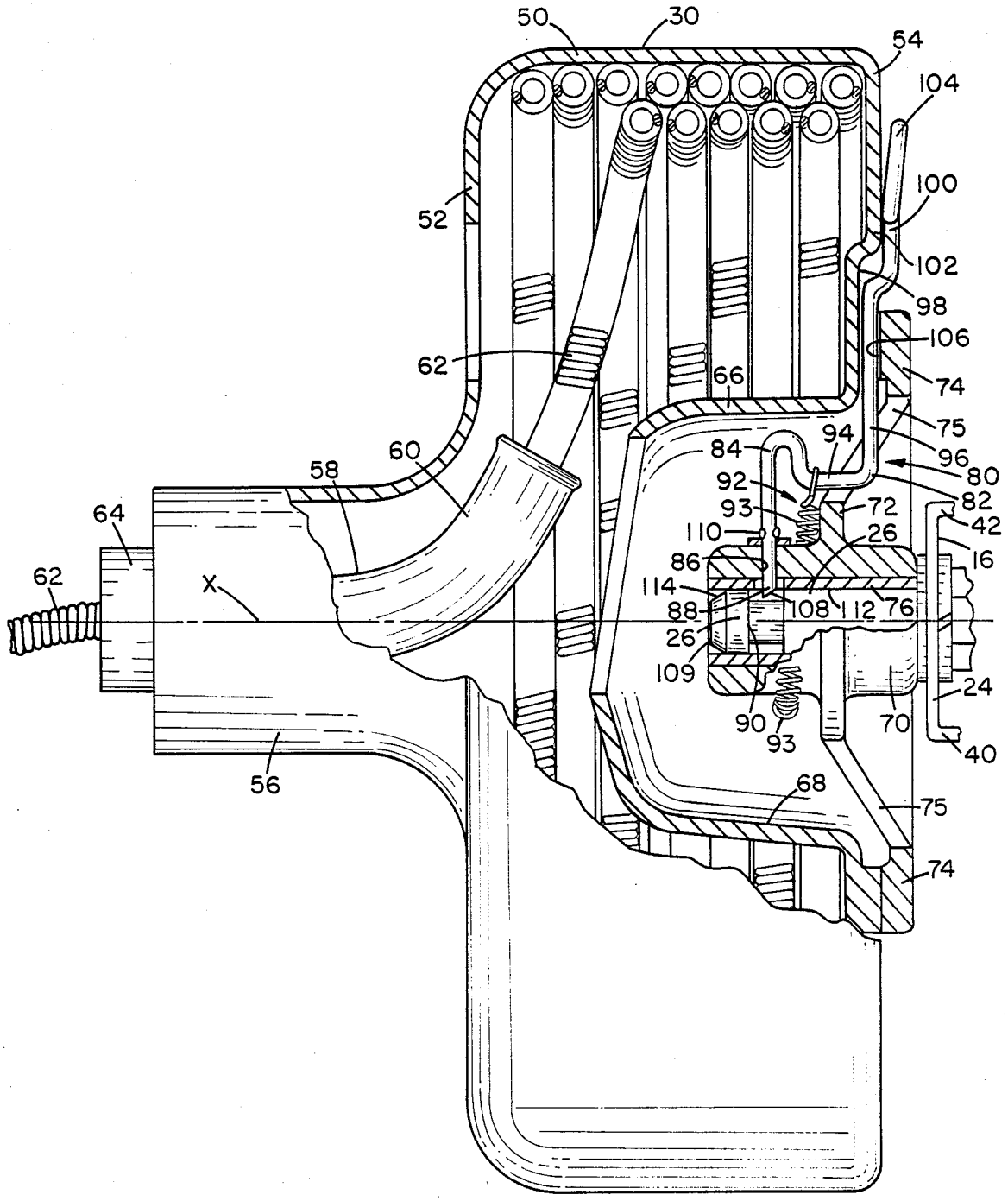

As shown in FIG. 3, the drum C has an axis X about which it rotates, and is comprised of an axial extending cylindrical outer wall 50 and radially inward extending front and back end walls 52 and 54, respectively. The front end wall 52 terminates in an axially outward extending cylindrical throat section 56 within which an axially extending cable guide tube 58 is supported. The guide tube 58 is formed with a curved inner end 60 leading into the hollow interior of the drum C and into which the conventional drain cleaning cable 62 stored in coiled condition in the drum is fed. Guide tube 58 terminates at its outer end in a nozzle end 64 out of which the cable 62 is fed into the drain pipe to be cleaned.

The back end wall 54 of the drum C is formed with a generally axially inwardly extending annular wall portion 66 forming a centrally located outwardly opening recess or well opening 68 therein within which a cylindrical hub or axle housing portion 70 of the drum is mounted in a position extending axially thereof. The hub portion 70 is provided with a generally radially outward extending and axially offset mounting flange 72 which extends alongside the back end wall 54 of the drum C for a short distance and is bolted thereto around its rim 74 to secure the hub portion 70 in place on the drum C in axially centered position thereon within the well opening 68. The offset portion of the flange 72 is provided with a plurality of apertures 75 spaced apart therearound for weight reducing purposes. The hub portion 70 is provided interiorly thereof with a cylindrical inner bearing 76 axially aligned with the drum axis X for journaling the drum C for rotation about its axis on the chassis mounted axle 26 of the machine A.

In accordance with the invention, the drum C is provided with integral retainer mechanism 80 for releasably mounting the drum on the axle 26 for rotation thereon while affording quick and easy disassembly therefrom when desired, as for replacement of the drum with a like drum provided with a different diameter cable 62 or for adding an additional length of cable to a cable already inserted in a drain pipe or sewer. The retainer mechanism 80 comprises an elongated retainer latch member 82 preferably in the form of a metal rod or bar which extends in a plane radially of the hub portion 70 and is provided with an inner end portion 84 which is slidable within a radially extending passageway 86 in the hub portion. The latch member 82 is biased inwardly of the hub portion 70 to engage at its inner end 88 within an annular groove 90 in the chassis mounted axle 26 to lock the drum C in place thereon against axial movement relative thereto.

The latch member 82 is biased radially inwardly of the hub portion 70 by suitable biasing member 92 which may comprise a tension or extension coil spring 93 connected at its opposite ends to an axially extending and radially inwardly offset crook portion 94 of the latch member and looped around the hub portion 70 in a tensioned condition. Alternatively, the biasing member 92 may comprise instead a garter spring or an elastic band or O-ring stretched and looped around the offset bent crook portion 94 of the latch member 82 and around the hub portion 70 of the drum. The inwardly offset crook portion 94 of the latch member 82 projects into and is accommodated within one of the weight reducing apertures 75 formed in and spaced apart around the offset web portion of the flange 72.

The outer end portion 96 of the latch member 82 extends radially outward of the hub portion 70, between the bolting rim 74 of the flange 72 on the hub portion 70 and the back end wall 54 of the drum C, through a grooved recess 98 formed in the back end wall 54 providing a confining guide channelway for the outer end portion 96 of the latch member 82. Outwardly beyond the rim 74 of the flange 72, the outer end portion 96 of the latch member 82 is offset axially outward from the back end wall 54 of the drum C to form an offset end portion 100 extending to the outside of the drum closely alongside and in engagement with the back end wall 54 of the drum, as indicated at 102. The offset end portion 100 of the latch member 82 terminates in a suitable hand hold or grip such as a ring-shaped portion 104 for enabling the manual grasping and radially outward pulling of the radially inward biased latch member 82 a sufficient distance to disengage its inner end 88 from within the annular groove 90 in the axle 26 so as to free the drum C for easy axial removal therefrom. As shown in FIG. 3, the hand grip 104 of the latch member 82 is bent at a slight angle outwardly away from the back end wall 54 of the drum C in order to provide clearance for enabling the manual grasping of the hand grip 104. The engagement of the outer end portion 96 of the latch member 82 in groove 98 and with the inside face 106 of the rim 74 of the hub flange 72 provides a guideway for the latch member 82 which, in coaction with the guiding of the inner end 88 of the latch member in the latch passageway 86 in the hub portion 70 of the drum C, assures the true radial outwardly release movement of the retainer latch member 82, when manually pulled outwardly to release the drum C from its locked position on the chassis axle 26. This prevents the binding of the latch member in the latch passageway 86.

The inner end extremity of the inner end portion 84 of the retainer latch member 82 is beveled as indicated at 108 in a direction for camming engagement with the end 109 of the axle 26, when the drum C is axially moved onto the axle, to thereby displace the retainer latch member 82 radially outward to permit the unrestricted axial movement of the drum C into its latched position on the axle 26. Also, the inner end portion 84 of the latch member 82 is provided with a suitable stop such as a pair of diametrically opposite upset projections 110 thereon for engaging with the outer side of the hub portion 70 to limit the radial inward biased movement of the latch member into the hub portion to a position in which only the beveled inner end extremity 108 of the latch member projects into the axle receiving bearing opening 112 of the hub portion so as to assure the camming engagement of the beveled inner end extremity with the end of the axle 26 during the axial movement of the drum C thereonto. To facilitate the camming action of the beveled inner end extremity 108 to displace the retainer latch member 82 radially outward during the axial movement of the drum C onto the axle 26 to rotatively mount it in place thereon, the end 109 of the axle 26 is also beveled as indicated at 114 in order to also have camming engagement with the beveled inner end extremity 108 of the retainer latch member 82.

During the axial movement of the hub portion 70 of the drum C onto the axle 26 of the machine frame or chassis B to rotatively mount the drum in place thereon, the retainer latch 82 is radially retracted out of the axle bearing opening 112, by the camming interengagement of the beveled camming surfaces 108 and 114 on the latch 82 and axle 26, to permit the movement of the drum hub portion 70 to its fully inserted position on the axle 26 at which time the biased retainer latch 82 then snap-locks into the annular groove 90 on the axle to lock the drum C in place thereon. The drum may be quickly and easily disassembled from the machine frame or chassis B, as for replacement by another drum, simply by manually pulling the biased retainer latch 82 radially outwardly of the drum a sufficient distance to disengage the inner end 88 of the latch from its locking engagement within the annular groove 90 in the axle 26, thereby freeing the drum for axial removal from the axle.

From the above description, it will be apparent that the present invention provides a drain cleaner machine of novel construction in which the axle on which the rotary drum rotates is mounted on the machine frame or chassis instead of on the drum as has been customary heretofore, thereby reducing the weight of the normally cumbersome drum with its stored drain cleaning cable and thereby rendering it easier to handle both when assembling it with, or when disassembling it from the chassis as for replacing it with another drum containing a different diameter cable. Moreover, the provision in accordance with the invention of the releasable retainer mechanism 80 for locking the drum C in place on the axle 26 enables the quick and easy assembly of the drum C in rotative mounted position on the chassis of the machine as well as its disassembly therefrom as for cleaning and repair purposes or for replacing it with another drum with a different diameter cable or to add an additional length of cable to a cable already inserted in a drain, where the job requires a greater length of cable.

The invention has been described with reference to the preferred embodiment. Obviously modifications and alterations will occur to others upon the reading and understanding of this specification and it is my intention to include all such modifications and alterations insofar as they come within the scope of the appended claims.

Having thus described the invention, it is claimed:

1. A drain cleaner machine including a cable storage drum, a chassis on which the said drum is adapted to be removably rotatably mounted on an axle fixedly mounted on said chassis, said drum including a hub portion for journaling the drum on said axle, and a retainer mechanism on said drum and engageable with shoulder means on said axle for detachably locking the said drum in place on said axle for rotation thereon.

2. A drain cleaner machine as defined in claim 1, wherein the said retainer mechanism is mounted on the said hub portion of said drum.

3. A drain cleaner machine as defined in claim 2, wherein the said retainer mechanism comprises a manually operable retainer latch slidable in said hub portion radially thereof and engageable within an annular retainer groove in said axle.

4. A drain cleaner machine as defined in claim 3, wherein the said retainer latch is biased into engagement with the said annular retainer groove in said axle.

5. A drain cleaner machine as defined in claim 4, wherein the said retainer latch is provided at its outer end with a hand grip for manually pulling the said biased latch radially outwardly relative to the said hub portion to disengage the latch from engagement within the said annular retainer groove in said axle so as to free the said drum for axial removal therefrom.

6. A drain cleaner machine as defined in claim 4, wherein the said retainer latch is comprised of a rod member and the said hand grip thereof is formed by a ring-shaped outer end portion of said rod member.

7. A drain cleaner machine as defined in claim 4, wherein the said drum comprises an outer drum wall portion joined by a back end wall to an inwardly extending inner drum wall portion forming an axially outwardly opening well recess in said back end wall in which the said hub portion is disposed, said hub portion comprising a cylindrical bearing portion for journaling the hub portion and associated drum on said axle and a generally radially outwardly projecting flange portion extending alongside and fixedly secured to the said back end wall of the said drum, said back end wall being provided with a radially outwardly extending grooved recess providing a guide channelway, extending between the said flange portion and the said back end wall, through which the said retainer latch extends and is guided for essentially true radially outward movement when actuated to release the drum from the said axle.

8. A drain cleaner machine as defined in claim 7, wherein the outer end portion of the said retainer latch extending radially outward beyond the said flange on the hub portion is offset axially outwardly of the drum and out of the said guide channelway in the said back end wall thereof so as to extend outwardly thereadjacent in position to enable manual grasping of a hand grip thereon to release the latch.

9. A drain cleaner machine as defined in claim 4, wherein the inner end of the said retainer latch engaged with the said annular retainer groove in said axle is beveled for camming engagement with the end of the said axle when the said drum is axially moved onto the axle, to thereby displace the retaining latch radially outward to permit the full unrestricted movement of the drum into its latched position.

10. A drum cleaner machine as defined in claim 4, wherein the said retainer latch is provided with stop means engageable with the outer side of said hub portion to limit radially inward biased movement of the retainer latch into the hub portion to a position in which only the said beveled inner end of the latch projects into the axle receiving bearing opening of the hub portion.

11. A drain cleaner machine as defined in claim 10, wherein the said stop means on the said retainer latch is constituted by laterally extending upset projections on the latch.

12. A drain cleaner machine as defined in claim 3, and including spring means connected and energized between the said retainer latch and said hub portion to normally bias the said latch inwardly of said hub portion and into engagement with the said annular retainer groove in said axle.

13. A drain cleaner machine as defined in claim 12, wherein the said spring means comprises a tension spring tensioned between the said retainer latch and said hub portion.

14. A drain cleaner machine as defined in claim 13, wherein the said tension spring means comprises an extension coil spring looped around the said hub portion of said drum and connected at its opposite ends in a tensioned condition to said latch.

15. A drain cleaner machine as defined in claim 13, wherein the said tension spring means comprises an elastic garter spring looped around the said hub portion of said drum and around an axially extending offset crook portion of said retainer latch in an elastically tensioned condition.

16. A drain cleaner machine as defined in claim 15, wherein the said elastic spring comprises an elastic band.

17. A drain cleaner machine including a cable storage drum, a chassis on which the said drum is adapted to be removably rotatably mounted on an axle fixedly mounted on said chassis and provided with an annular retainer groove, said drum including a hub portion for rotatably mounted the said drum on the said axle, and retainer mechanism for detachably locking the said drum in place on the said axle, said retainer mechanism comprising a retainer latch extending through a confining radial aperture in said hub portion and generally radially outward therefrom to an exposed position outwardly of the drum, and spring means energized between the said retainer latch and said hub portion and normally biasing the said retainer latch radially inwardly of said hub portion and into engagement with the said annular retainer groove in said axle to detachably lock the said drum in place thereon.

18. A drain cleaner machine as defined in claim 17, wherein the said spring means comprises tension spring means tensioned between the said retainer latch and said hub portion of said drum.

* * * * *